United States Patent [19]

Griffin

[11] Patent Number: 4,490,991

[45] Date of Patent: Jan. 1, 1985

[54] HIGH-SIDE REFRIGERATION SYSTEM ASSEMBLY ADAPTED TO BE MOUNTED IN A REFRIGERATOR MACHINERY COMPARTMENT

[75] Inventor: James R. Griffin, Louisville, Ky.

[73] Assignee: General Electric Company, Louisville, Ky.

[21] Appl. No.: 566,890

[22] Filed: Dec. 29, 1983

[51] Int. Cl.[3] ..... F25B 47/00

[52] U.S. Cl. ..... 62/279; 62/295; 62/448; 62/455

[58] Field of Search ..... 62/279, 295, 448, 455

[56] References Cited

U.S. PATENT DOCUMENTS

| | | | |
|---|---|---|---|
| 2,462,115 | 2/1949 | Luecke | 62/116 |
| 3,116,614 | 1/1964 | King | 62/283 |
| 3,116,615 | 1/1964 | Harle | 62/283 |
| 3,225,563 | 12/1965 | Braun | 62/277 |
| 3,433,031 | 3/1969 | Scheitlin et al. | 62/448 |
| 3,524,329 | 8/1970 | Smith et al. | 62/295 |
| 3,736,768 | 6/1973 | Harbour et al. | 62/455 |
| 3,785,168 | 1/1974 | Domingorene | 62/455 |
| 4,023,380 | 5/1977 | Drouin | 62/279 |
| 4,156,352 | 5/1979 | Gelbard et al. | 62/285 |

*Primary Examiner*—Lloyd L. King

*Attorney, Agent, or Firm*—F. P. Giacalone; R. M. Reams

[57] ABSTRACT

A unitary high-side refrigeration system assembly adapted to be installed in the machinery compartment of a domestic refrigerator including a condensate collection support member on which the refrigeration system high-side components including the compressor, condenser and air moving means are mounted.

8 Claims, 8 Drawing Figures

HIGH-SIDE REFRIGERATION SYSTEM ASSEMBLY ADAPTED TO BE MOUNTED IN A REFRIGERATOR MACHINERY COMPARTMENT

BACKGROUND OF THE INVENTION

The present invention relates generally to refrigerators of the type wherein the high-side portion of the refrigeration system is arranged in a machinery compartment which is generally isolated from the food storage compartment of the refrigerator.

In many refrigerators, such as that disclosed in U.S. Pat. No. 4,156,352 Gelbard et al. assigned to the General Electric Company the assignee of the present invention, a motor compressor and a condenser are mounted in a machinery compartment at the bottom of a cabinet and a fan is provided for circulating air through the compartment and over the components. While the arrangement of locating the high-side refrigerator components in a single machinery compartment is an acceptable way of isolating the heat generating components from the food compartment being refrigerated, it has some drawbacks. Generally, it is desirable that the size of the machinery compartment is kept at a minimum so that maximum cabinet space may be devoted to the refrigerated storage portion of the cabinet. Placing all of the high-side components in a relatively small compartment poses certain manufacturing problems in securing individual components. In part, this has been solved in some instances by creating unitary assemblies such as disclosed in U.S. Pat. No. 3,524,326, wherein the compressor, condenser and an air circulating means are mounted on a supporting member which is inserted into and removed from the refrigerator machinery compartment. It has also been common practice to direct condensate water from the evaporator which is located in the food storage compartment to a condensate collection pan located in the machinery compartment where it may be evaporated by the circulating warm air directed across the relatively warm high-side refrigerator components. Since the high-side components are cooled by circulating air through the machinery compartment, means such as baffling must be provided for insuring that substantially all of the air passing through the compartment is directed across the components. This generally requires the placement of baffles in the compartment relative to the fan so that incoming air is directed across the relatively warm operating components.

SUMMARY OF THE INVENTION

Accordingly, it is an object of the present invention to provide a high-side refrigeration system which is assembled as a complete unitary system prior to its installation in a refrigerator machinery compartment.

Another object is to provide a unitary high-side assembly which includes a condensate collection and disposal system and an air baffling arrangement for directing incoming air across the components of the assembly.

A household refrigerator is provided including a cabinet having a food compartment to be refrigerated in the upper portion thereof. The food compartment is separated by an insulated partition to include a machinery compartment in the lower portion of the cabinet having an air inlet opening and an air outlet opening. A unitary refrigeration apparatus including the high-side components of the refrigeration system is provided which is adapted to be arranged in the machinery compartment. The unitary apparatus includes a condenser, a compressor and air moving means for circulating air through the machinery compartment. The unitary removable refrigeration apparatus comprises a support member on which the high-side components are arranged. The support member is adapted to be inserted into the machinery compartment and includes a bottom wall, and upwardly extending peripheral side walls defining a condensate collection area, and air duct means for directing air across the highside components.

Securing means on the support member are adapted to engage locating means in the machinery compartment for positioning and securing the unitary high-side refrigerating apparatus in the machinery compartment between the air inlet and outlet openings. An impervious wall is provided on the bottom wall of the support member which extends upwardly to a position below a predetermined normal level of condensate to define a condensate overflow containment area in the support member which allows condensate from the collecting area to flow into the containment area when the level in the collecting area is above the predetermined normal level. Also provided in the support member is a compressor support means including resilient means interposed between the compressor and the bottom wall of the support member. The resilient means is dimensioned for supporting the compressor relative to the condensate overflow containment area so that excess condensate flowing into the containment area contacts the relatively warm compressor to thereby be evaporated by the heat generated by the operating compressor. There is also provided wall portions on the support member forming the air duct which divides the machinery compartment between the air inlet area and the air outlet area. A fan is mounted on the wall portion for circulating air between the air inlet and air outlet. The condenser is formed to include at least one serpentine section and is supported on means located on the edge of the support member toward the air openings. The support means are dimensioned to engage spaced tube passes of the condenser in a manner which secures the condenser in the air inlet area relative to the support member for causing air to circulate between the air inlet and air outlet.

DESCRIPTION OF THE PREFERRED EMBODIMENT

Figures 1, 8:
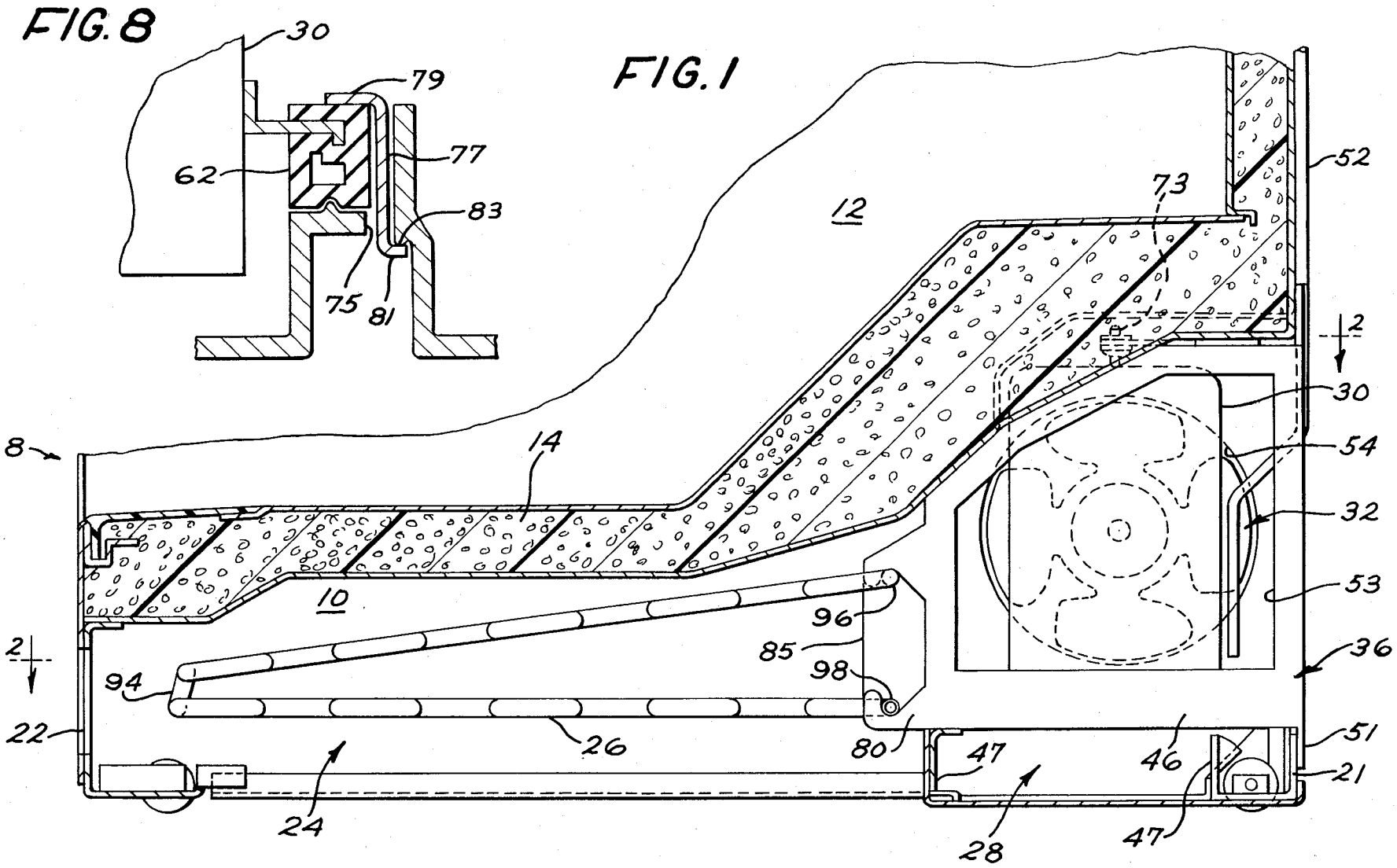
FIG. 1 is a vertical sectional view of a portion of a refrigerator showing the machinery compartment and unitary high-side refrigerator components arrangement of the invention.
FIG. 8 is a fragmentary elevational view of another embodiment of the compressor mounting arrangement.

With reference to the accompanying drawings and particularly FIG. 1, there is shown a portion of a household refrigerator cabinet 8 including a machinery compartment 10 in the lower portion of the cabinet. This compartment is separated from a refrigerated storage compartment 12 by an insulated wall 14 forming the top wall of the machinery compartment. The compartment 10 is further defined (FIG. 2) by side walls 16 and 18 of the cabinet and a rear wall 20 having an opening 21 and has an air inlet opening 22 at the front thereof. The inlet opening 22 extends substantially the full width of the compartment and is usually provided with a decorative grill (not shown).

Generally, the machinery compartment 10 has a relatively low profile forward section 24 at the front portion thereof for receiving a condenser 26 and a higher profile rear section 28 at the rear portion thereof for accommodating the motor compressor unit 30.

Figure 2:
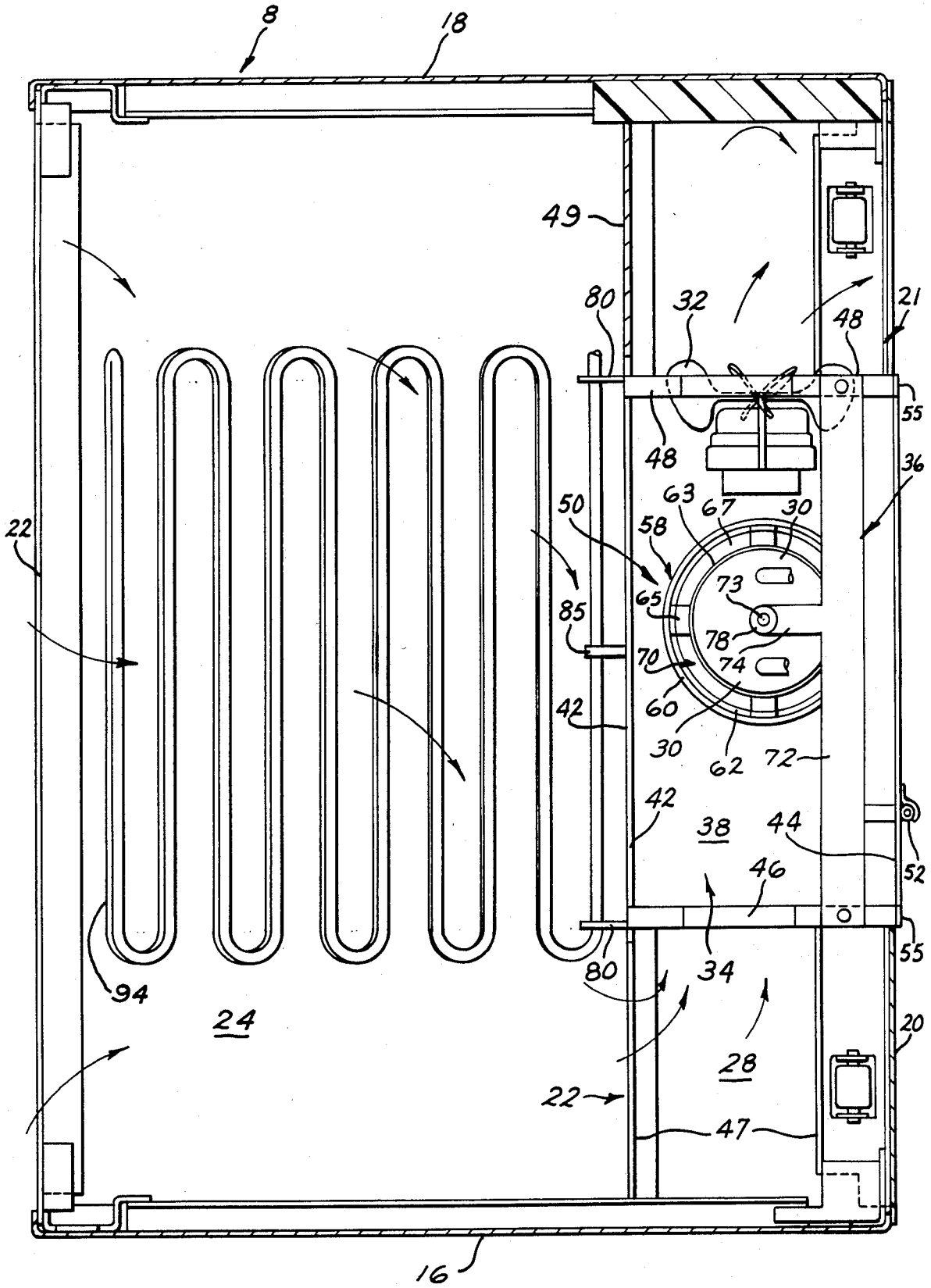
FIG. 2 is a sectional plan view taken along the line 2—2 in FIG. 1.
Figure 3:
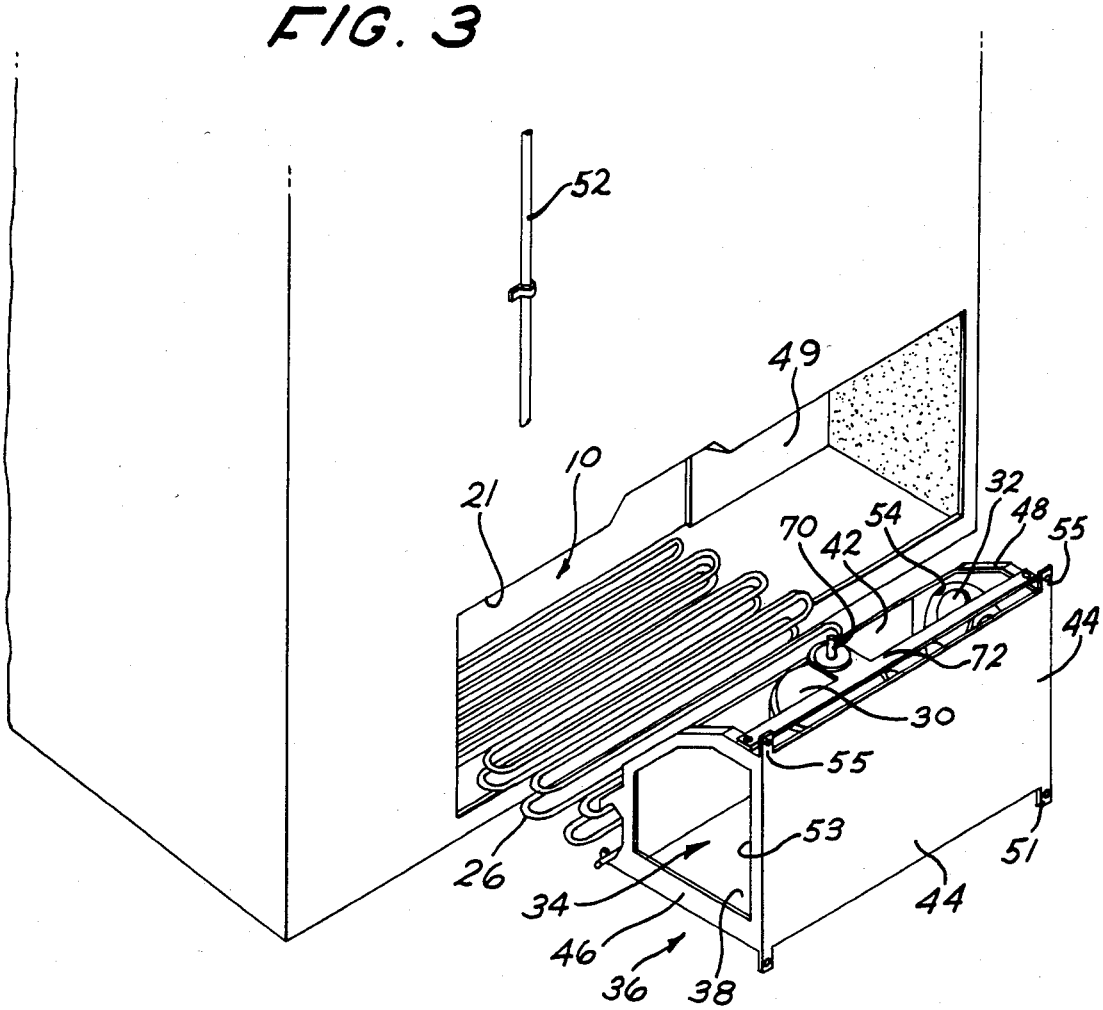
FIG. 3 is a perspective view showing the unitary high-side refrigerator components partially inserted in the machinery compartment.

In accordance with the present invention, a unitary assembly generally designated 36 is provided which includes substantially all of the high-side components of the refrigeration system, comprised of the motor compressor 30, condenser 26 and air moving fan 32. The unitary assembly is inserted into the machinery compartment 10 through rear opening 21 (FIG. 3) and is adapted to provide a transverse air duct 34 which, as will be explained hereinafter, serves to direct air through the compartment 10. The unitary assembly 36 includes a support member or base wall 38 on which the high-side components are mounted. The base wall 38 in the present instance is substantially rectangular and is formed with an upwardly extending peripheral wall including front and rear wall portions 42, 44 and side walls 46, 48 to provide a tray or condensate collection area 50 in the base wall 38 and to form air duct 34. Condensate from the evaporator (not shown) located in refrigerated storage compartment 12 is directed into the condensate collection area through a discharge conduit 52 (FIG. 1). The unitary assembly is dimensioned so that, as will now be explained, in its installed position the wall portions 42, 44, 46 and 48 of the support member form duct 34 and provide the necessary baffling for directing air from the inlet 22 to flow across the condenser 26, motor compressor 30 and out through opening 21. To this end, the upper edges of side walls 46 and 48 are configured to match the wall 14 as it extends between sections 24 and 28 of compartment 10. The front wall 42 extends upwardly to engage wall 14 in the transition area between portions 24 and 28 with the rear wall 44 covering the opening 21. The dimension of walls 42, 44, 46 and 48 relative to the compartment 10 creates a passageway defining air duct 34 formed through the assembly 36. While the wall 44 is shown as part of the assembly 36, it should be noted that wall 44 can be a separate member which is secured over opening 21 after the assembly is inserted into compartment 10. The inlet and outlet of the duct 34 are defined by the walls 46, 48, respectively, with wall 46 provided with an inlet opening 53 for receiving air from the forward section 24 and wall 48 with an outlet 54 in which fan 32 is arranged. In the installed position as shown in FIG. 2 the portion of the rear wall opening 21 through which the assembly is positioned in compartment 10 is covered in part by the wall 44 so that rear outlet opening 21 is defined by that area remaining uncovered between the cabinet wall 18 and wall 48. Short circuiting or recirculation of air in compartment 10 is prevented by a panel 49 (FIG. 2) which extends between wall 46 and cabinet wall 18 adjacent the front portion of member 36. Accordingly, air under influence of fan 32 entering front inlet 22 passes over the condenser 26, flows through duct 34, and exits opening 21 as indicated by airflow arrows. In certain high-side component configurations or capacities, it may be advantageous to direct a greater amount of air flow toward or over the compressor; accordingly, in those instances the wall 42 may be provided with openings. The assembly 36 is supported on cabinet support braces 47 which are secured to the cabinet 8 and extend between side walls 16 and 18. The assembly 36 is secured to the rear brace 47 through flanges 51 extending downwardly from wall 44, and to the cabinet 8 through flanges 55 extending upwardly from wall 44.

Figure 4:
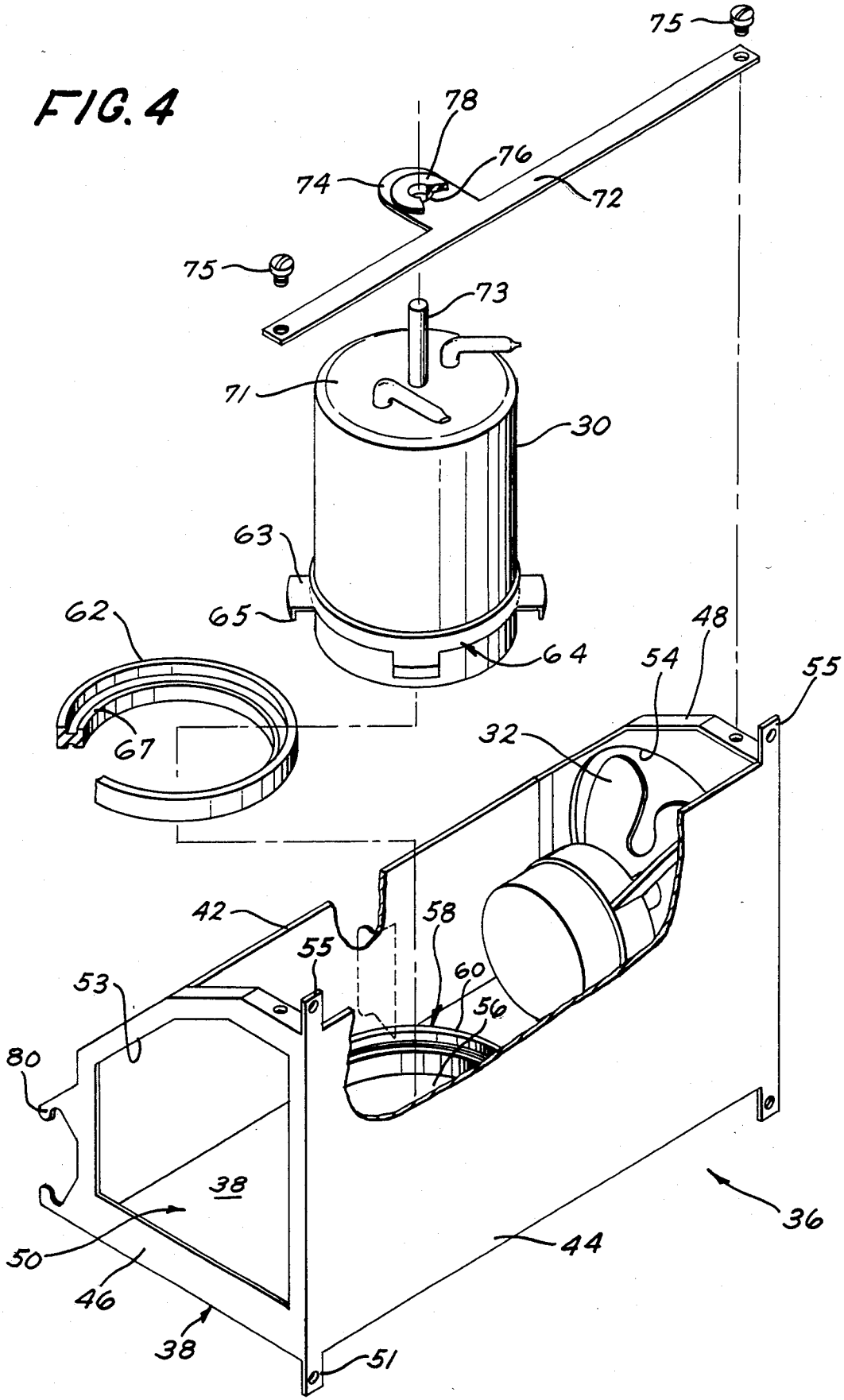
FIG. 4 is an exploded perspective of the unitary high-side refrigerator components showing details of construction.
Figure 7:
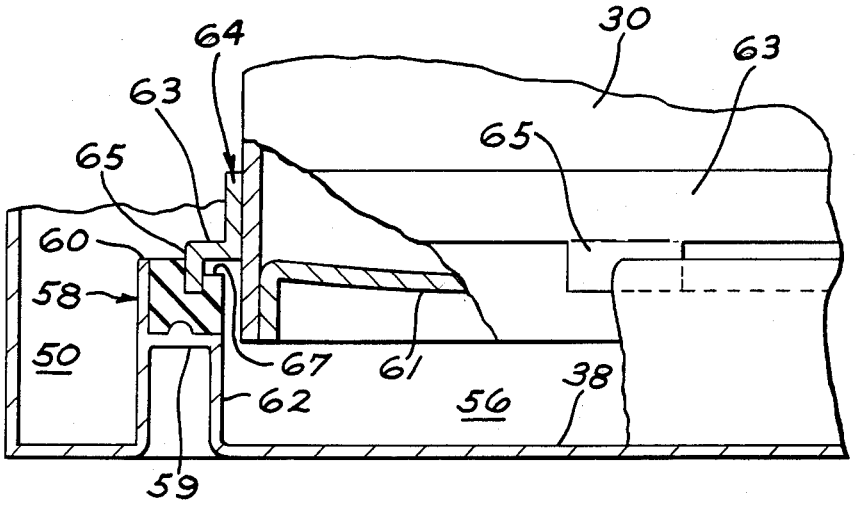
FIG. 7 is a fragmentary sectional view taken along lines 7—7 of FIG. 2 showing details of the compressor mounting arrangement of the present invention.

Under normal conditions, air flowing over the condensate collection area 50 whose temperature is raised by the relatively hot operating components is sufficient to facilitate the evaporation of the condensate collected in area 50. Under certain adverse conditions such as high humidity conditions, water may collect in area 50 at a rate which exceeds the ability of the air flow through compartment 10 to evaporate it. To this end, in accordance with the present invention, means are provided to cause excessive condensate collected in area 50 to flow into a containment area 56 where it will come in direct contact with a portion of the relatively hot compressor casing and be heated. Thus heated, the condensed water evaporates much faster than that remaining in area 50. As best seen in FIGS. 2, 4 and 7, the overflow condensate containment area 56 is formed in area 50 by an upwardly extending impervious wall 58. The height of wall 58 is such that its upper edge 60 is generally below a predetermined normal level of condensate and allows excessive condensate water to flow into the containment area 56 when the water in area 50 rises above the predetermined normal level. The motor compressor 30, as best seen in FIG. 7 and as will be fully explained hereinafter, is mounted so that its lower or bottom wall 61 is in fact located in the containment area 56.

The mounting arrangement of the compressor insures that the bottom wall 61 of the motor compressor casing is spaced from the bottom wall of base member 38 and, accordingly, since condensate will not be present in area 56 during normal conditions, the bottom wall of the motor compressor casing will be in contact with condensate water only during the overflow conditions described above. In the embodiment shown, the compressor 30 is resiliently supported so that its bottom wall 61 is arranged in the containment area 56. To this end, as shown in FIG. 7, a resilient ring 62 is arranged in the area 56. The ring 62 is supported in area 56 on an annular shoulder 59 formed inwardly of the wall 58. The compressor 30 is provided with an annular flange member 63 which is secured to the motor compressor outer casing. The flange includes a body portion 64 secured to the compressor casing outer wall and a generally radially extending support portion 65. The support portion 65 of flange 64 is adapted to be received in an annular groove 67 for supporting the compressor. As seen in FIG. 7 the resilient member is in fact trapped between the flange member 63 and shoulder 59 with the lowermost wall 61 of the motor compressor casing spaced from the bottom wall of base member 38, as described above. To insure that overflow condensate rising above wall 58 flows into containment area 56, the support portions 65 are in fact spaced circumferentially to provide openings 70 therebetween, as shown in FIG. 2, through which water may flow freely between the areas 50 and 56. Under normal conditions, as stated above, water is evaporated in area 50 as the air entering inlet 22 is warmed as it passes initially over the relatively warm condenser 26 and then across the water collected in area 50. During those above-normal conditions described above, overflow water will contact the relatively hot lower wall 61 of the compressor casing, and its evaporation will accordingly be facilitated.

While the resilient ring 62 provides an acceptable mount for the motor compressor during normal refrigerator operations, it may be possible during shipment or other moving operations of the refrigerator to displace the compressor relative to the ring 62 and its position in containment area 56. Accordingly, as shown in FIGS. 1–4, the compressor is supported at its upper end to insure its vertical axial stability. To this end, the compressor 30 is provided with an axially aligned stud 73 which is secured to and extends upwardly centrally from the upper wall 71 of the compressor. A support structure is provided including a transverse bracket 72 which is secured to the upper edges of walls 46 and 48 so as to extend over the compressor across the upper portion of duct 34. The bracket 72 includes a forwardly extending arm 74 which has formed therein an opening 76 in alignment with the stud 73. Located in opening 76 of bracket 72 is a resilient grommet 78 which is adapted to receive the stud 73. With the compressor 30 located on the resilient member 62, as described above, the bracket 72 is lowered until the stud 73 is inserted in grommet 78. The bracket 72 is then secured to the upper edge walls 46 and 48 as by bolts 75 to thereby stabilize the vertical axis of the compressor.

With reference to FIG. 8, there is shown another embodiment of holding the compressor relative to the base member 38. In carrying out the embodiment the ring 62 is formed with a horizontal slot which accommodates the support 65. Circumferentially spaced openings 75 are formed in shoulder 59 adjacent the wall 58. There is further provided Z-shaped clips which include a body portion 77, a locating projection 79 and a locking portion 81 which is adapted to engage a latching portion 83 formed in the wall 58. There is provided a clip for each opening 75 which are installed so that the body portion 77 is positidned through opening 75 with the locking portion in engagement with latching portion 83, and portion 79 forcibly engaging the upper face of ring 62. This arrangement stabilizes the vertical axis of the compressor.

Figure 5:
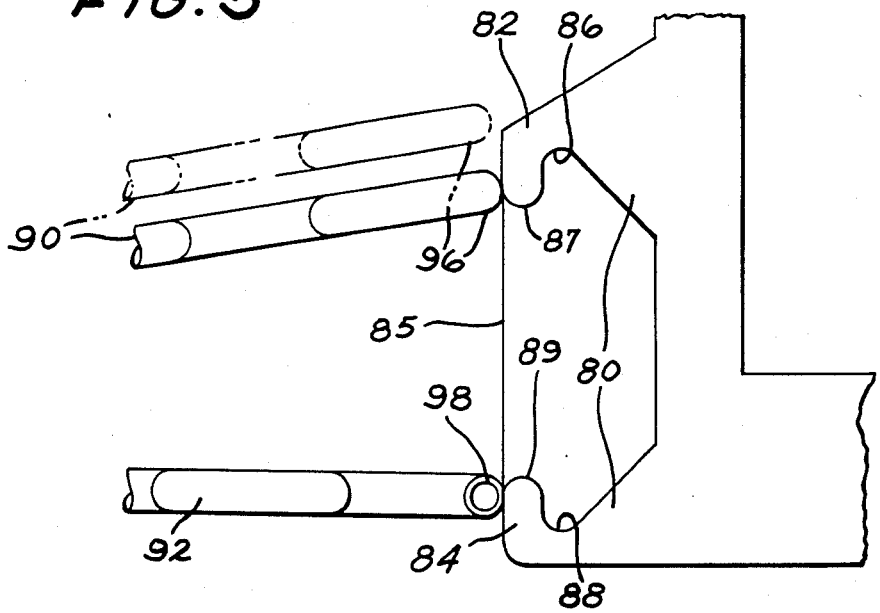
FIG. 5 a fragmentary elevational view showing a step in the condenser mounting arrangement.

Means are also provided as part of the unitary high-side system for securing the condenser 26 to the assembly 36. To this end, as shown in FIGS. 1 and 5, there is formed as part of the base member 38 and extending forwardly from the area adjacent the side walls 46 and 48 a pair of brackets 80, each including an upper member 82 and a lower member 84. The upper members 82 are formed to include a downwardly facing tube holding area 86 defined by lug 87. The lower brackets 84 are formed to include an upwardly facing tube holding area 88 defined by a lug 89. The condenser to be secured to the bracket is generally fabricated to include two flat serpentine tube sections 90, 92 which diverge from a front apex 94 (FIG. 1) to an upper and lower divering tube ends 96 and 98, respectively. The vertical dimension between the tube ends 96 and 98 in the normal relaxed position is generally greater than the vertical dimension of the opening to the holding areas 86, 88 defined by lugs 87, 89 of tube holding areas 86 and 88. Accordingly, as the diverging ends 96 and 98 of the condenser 26 are forced into engagement with lugs 87 and 89. As shown in FIG. 5, the ends 96, 98 of the condenser initially compress toward each other to cam over the ends of lugs 87 and 89 and then expand into the holding areas 86 and 88 to be rigidly held relative to the assembly 36 as shown in FIG. 1. To insure that the condenser is securely held relative to the assembly 36 there is further provided a bracket 85 which is located intermediate the bracket 80. Bracket 85 is formed to include holding areas 91 which face the areas 86 and 88. The vertical dimension between areas 91 is slightly greater than the vertical dimension between areas 86 and 88 so that the condenser tube ends are slightly bowed into an interference fit between the areas 91 and 86, 88.

Figure 6:
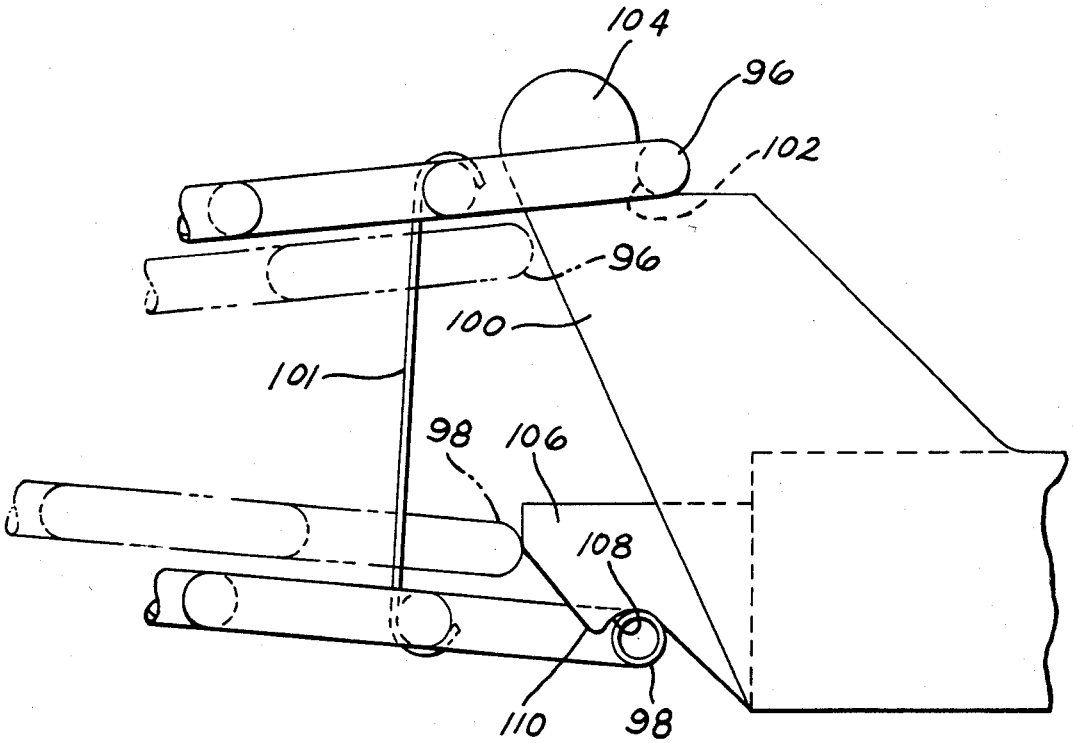
FIG. 6 is a fragmentary elevational view showing a step in the condenser mounting arrangement of another embodiment.

Another embodiment for supporting the condenser to the assembly is shown in FIG. 6 wherein like parts are designated by the same reference numerals used in the above description. Similar to the embodiment of FIGS. 1 and 5, there is formed as part of base 38 at the ends adjacent the end walls 46 and 48 and extending forwardly toward front opening 22 a pair of projecting brackets 100. The brackets 100 are formed to include an upwardly facing tube holding area 102 defined by lug 104. Also formed in base 38 at the lower center portion of wall 42 is a holding member 106 which includes a downwardly facing tube holding area 108 defined by a lug 110. In this embodiment, the vertical dimension between the tube passes 96 and 98 at the diverging end of the condenser 26, as shown in broken lines, is less than the vertical dimension of the access to tube holding areas 102 and 108 as defined by lugs 104 and 110. Accordingly, as the diverging ends 96 and 98 of the condenser are forced into engagement with the lugs 104, 110, respectively, as shown in FIG. 6, the ends of the condenser spread apart to cam over the lugs 104, 110 and spring back into engagement with areas 102, 108 to be held rigidly relative to the member 36. To insure that the condenser is securely held relative to the assembly 36 in this embodiment a clip 101 may be provided which is dimensioned to force tube ends 96, 98 into engagement with the areas 102, 108, respectively.

The foregoing is a description of the preferred embodiment of the apparatus of the invention, and it should be understood that variations may be made thereto without departing from the true spirit of the invention as defined in the appended claims.

What is claimed is:

1. A household refrigerator including:

a cabinet having a compartment to be refrigerated in the upper portion thereof separated by an insulated partition to include a high-side unit compartment in the lower portion of said cabinet having an air inlet opening and an air outlet opening;

a unitary refrigerating apparatus arranged in said condensing unit compartment including a condenser, a compressor and a fan means for circulating air through said condensing unit compartment;

said unitary removable refrigeration apparatus comprising a support member arranged in said high-side unit compartment having a bottom wall and upwardly extending peripheral side walls defining a condensate collection area;

securing means on said support member adapted to engage locating means in said high-side compartment for positioning and securing said unitary refrigerating apparatus in said high-side compartment;

an impervious wall on said bottom wall of said support member extending upwardly to a position below the upper edge of said peripheral wall of said support member defining a condensate overflow containment area so as to allow overflow condensate from said condensate collecting area to flow into said containment area;

compressor support means including resilient means interposed between said compressor and said bottom wall of said support member being dimensioned for supporting said compressor in said condensate overflow containment area so that condensate in said containment area contacts said compressor whereby said overflow condensate is evaporated by the heat generated by the operation components of the compressor;

a wall portion on said support member dividing said high-side unit compartment between said air inlet area and said air outlet area;

a fan mounted on said wall portion for circulating air between said air inlet and air outlet;

said condenser including an upper and lower serpentine tube section folded to a substantial V-shape with the apex facing said air inlet and the diverging upper and lower tube portions being adjacent said support member;

condenser support means on the edge of said support member toward said air openings being dimensioned to engage the diverging ends of said condenser for securing said condenser in said air inlet area relative to said support member.

2. The invention recited in claim 1 wherein said resilient means is ring-shaped and said impervious wall includes an annular shoulder for supporting said resilient ring means.

3. The invention recited in claim 2 wherein flange portions secured to said compressor and extending radially outwardly therefrom are dimensioned to engage said resilient ring so that said compressor is resiliently supported on said resilient ring through said flange portions.

4. The invention recited in claim 3 wherein said compressor is a rotary motor compressor supported with its axis arranged vertically and said compressor support means further includes means for stabilizing said vertical axis comprising: a stud member extending upwardly from said compressor, a cross member secured to said upwardly extending peripheral side walls having resilient means thereon engaging said stud for supporting said compressor.

5. The invention recited in claim 3 wherein said flange portion is positioned in said resilient ring and said compressor support means further includes a holding clip having a portion engaging the upper wall of said resilient ring and including a locking portion engaging a latching portion on said impervious wall for securing said compressor relative to said support member.

6. The invention recited in claim 1 wherein said unitary removable refrigeration apparatus further comprises baffle means on said support member forming an air duct in said high-side unit compartment for directing air therethrough across said condenser and said compressor.

7. The invention recited in claim 6 wherein said condenser support means includes a pair of support brackets having upper and lower members projecting outwardly therefrom, said upper member having a downwardly facing tube holding area, said lower member having an upwardly facing tube holding area, said tube holding area being spaced vertically a distance less than the vertical spacing of said diverging upper and lower tube portions to securely hold said condenser relative to said support member.

8. The invention recited in claim 6 wherein said condenser support means includes a pair of upper support brackets having upwardly facing tube holding areas, and a lower support bracket arranged centrally on said support member having a downwardly facing tube holding area, said tube holding areas being spaced vertically a distance greater than the vertical spacing of said diverging upper and lower tube portions to securely hold said condenser relative to said support members.

* * * * *